US008061973B2

(12) United States Patent
Devine, II

(10) Patent No.: US 8,061,973 B2
(45) Date of Patent: Nov. 22, 2011

(54) TURBOMACHINE INCLUDING AN ADAPTABLE INTAKE SYSTEM AND METHOD OF CONTROLLING AIRFLOW TO A TURBOMACHINE

(75) Inventor: Robert Henry Devine, II, Lees Summit, MO (US)

(73) Assignee: General Electric Company, Schenectady, NY (US)

( * ) Notice: Subject to any disclaimer, the term of this patent is extended or adjusted under 35 U.S.C. 154(b) by 799 days.

(21) Appl. No.: 12/172,342

(22) Filed: Jul. 14, 2008

(65) Prior Publication Data

US 2010/0008763 A1 Jan. 14, 2010

(51) Int. Cl.
*F01D 5/02* (2006.01)

(52) U.S. Cl. ..... 415/129; 415/1; 415/130; 415/131; 415/132; 415/133; 415/145

(58) Field of Classification Search ..... 415/1, 129, 415/130, 131, 132, 133, 145
See application file for complete search history.

(56) References Cited

U.S. PATENT DOCUMENTS 5,472,314 A * 12/1995 Delonge et al. ..... 415/156
6,865,891 B2 * 3/2005 Walsh et al. ..... 60/792
7,004,723 B2 2/2006 Raulin et al.

FOREIGN PATENT DOCUMENTS

EP 1 469 166 B1 8/2006

* cited by examiner

*Primary Examiner* — Jarrett Stark
*Assistant Examiner* — Nicholas Tobergte
(74) *Attorney, Agent, or Firm* — Cantor Colburn LLP

(57) ABSTRACT

A turbomachine includes a compressor having a compressor intake, and an intake system mounted upstream of the compressor intake. The intake system includes a housing and a plurality of selectively positionable vanes arranged within the housing. The plurality of selectively positionable vanes are moveable between a first position to remove a first amount of foreign particles, and a second position, to remove a second amount of foreign particles.

20 Claims, 3 Drawing Sheets

TURBOMACHINE INCLUDING AN ADAPTABLE INTAKE SYSTEM AND METHOD OF CONTROLLING AIRFLOW TO A TURBOMACHINE

BACKGROUND

The present invention relates to the art of turbomachines and, more particularly, to an adaptable intake system for a turbomachine.

Modern turbomachines include a number or rotating components that operate within tight tolerances. Foreign matter ingested into the turbomachine can cause damage, excessive wear, or even catastrophic failure. Thus, turbomachines are provided with various systems to remove foreign particulate and moisture from intake airstreams. Geographical constraints dictate particulate and moisture removal levels for turbomachines. Machines operating in a relatively dry, clean environment require a lower level or degree of particulate removal as compared with machines operating in harsh environments such as, off-shore oil rigs, mobile and/or marine uses.

The geographical constraint(s) is a determining factor for inlet design when seeking optimal performance from the turbomachine. The geographical constraint(s) also becomes a limitation when constraining factors, such as dust, rain, foreign debris, and the like are not present on a continuing basis. Existing systems employ fixed filtering devices or barriers that screen particulate from intake airstreams. While effective during times when particulate is present, the fixed devices represent a flow restriction that limits intake air volume and, as a consequence, turbomachine efficiency during times when particulate levels are low.

BRIEF DESCRIPTION OF THE INVENTION

A turbomachine includes a compressor having a compressor intake, and an intake system mounted upstream of the compressor intake. The intake system includes a housing and a plurality of selectively positionable vanes arranged within the housing. The plurality of selectively positionable vanes are moveable between a first position to removes a first amount of foreign particles, and a second position, to removes a second amount of foreign particles.

In accordance with another exemplary embodiment of the present invention, a method of controlling airflow for a turbomachine includes positioning a plurality of vanes, shiftably mounted at the intake system, between a first position, and a second position. When in the first position, the plurality of vanes remove a first amount of foreign particles, and when in the second position, the plurality of vanes remove a second amount of foreign particles.

In accordance with yet another exemplary embodiment of the invention, an intake system for a turbomachine includes a housing, and a plurality of selectively positionable vanes arranged within the housing. The plurality of selectively positionable vanes are moveable between a first position to removes a first amount of foreign particles, and a second position to removes a second amount of foreign particles.

Additional features and advantages are realized through the techniques of exemplary embodiments of the present invention. Other embodiments and aspects of the invention are described in detail herein and are considered a part of the claimed invention. For a better understanding of the invention with advantages and features, refer to the description and to the drawings.

DETAILED DESCRIPTION

Figure 1:
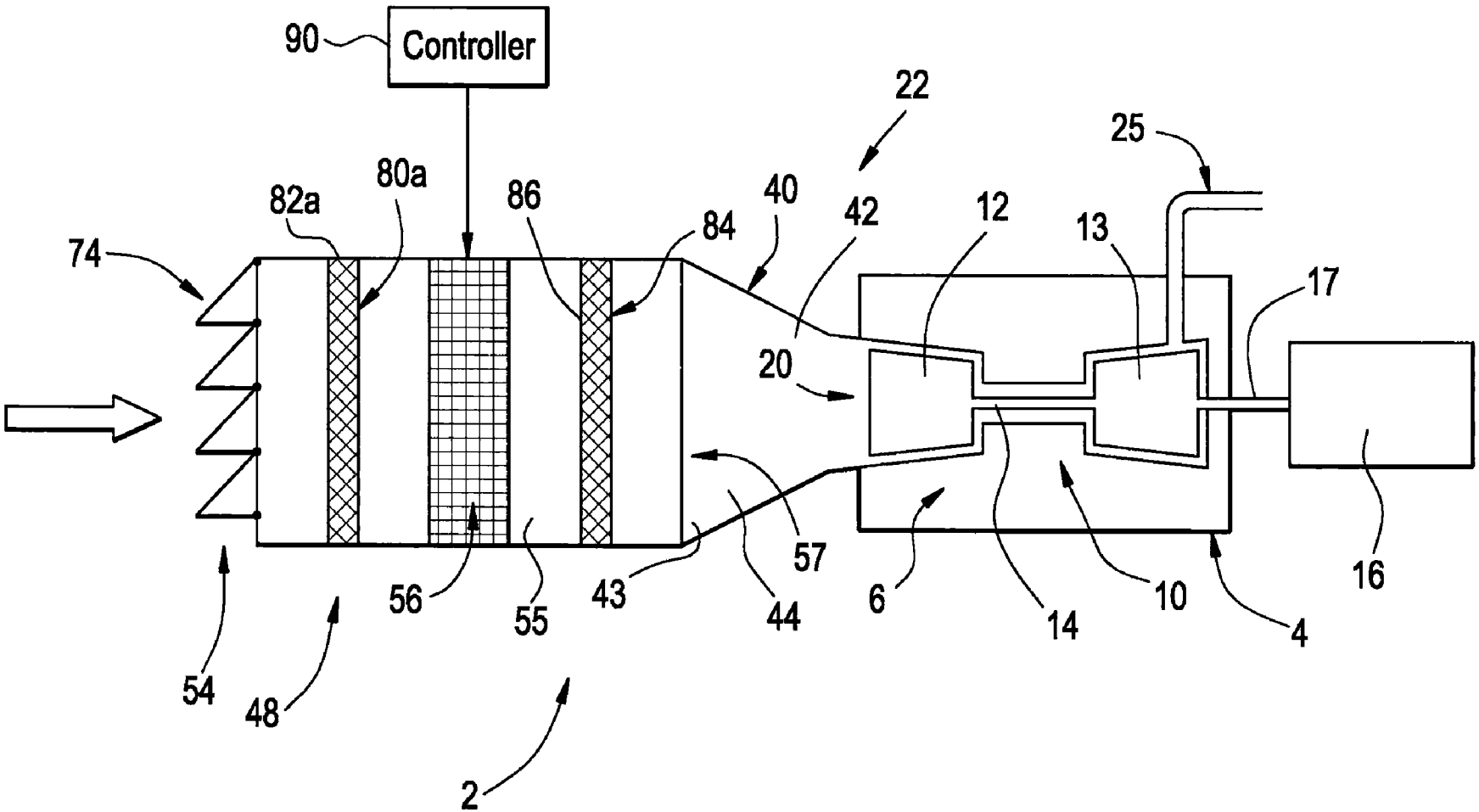
FIG. 1 is a schematic view of a turbomachine system including an adaptable intake system in accordance with exemplary embodiments of the invention illustrating a plurality of selectively movable vanes in a first position.
Figure 2:
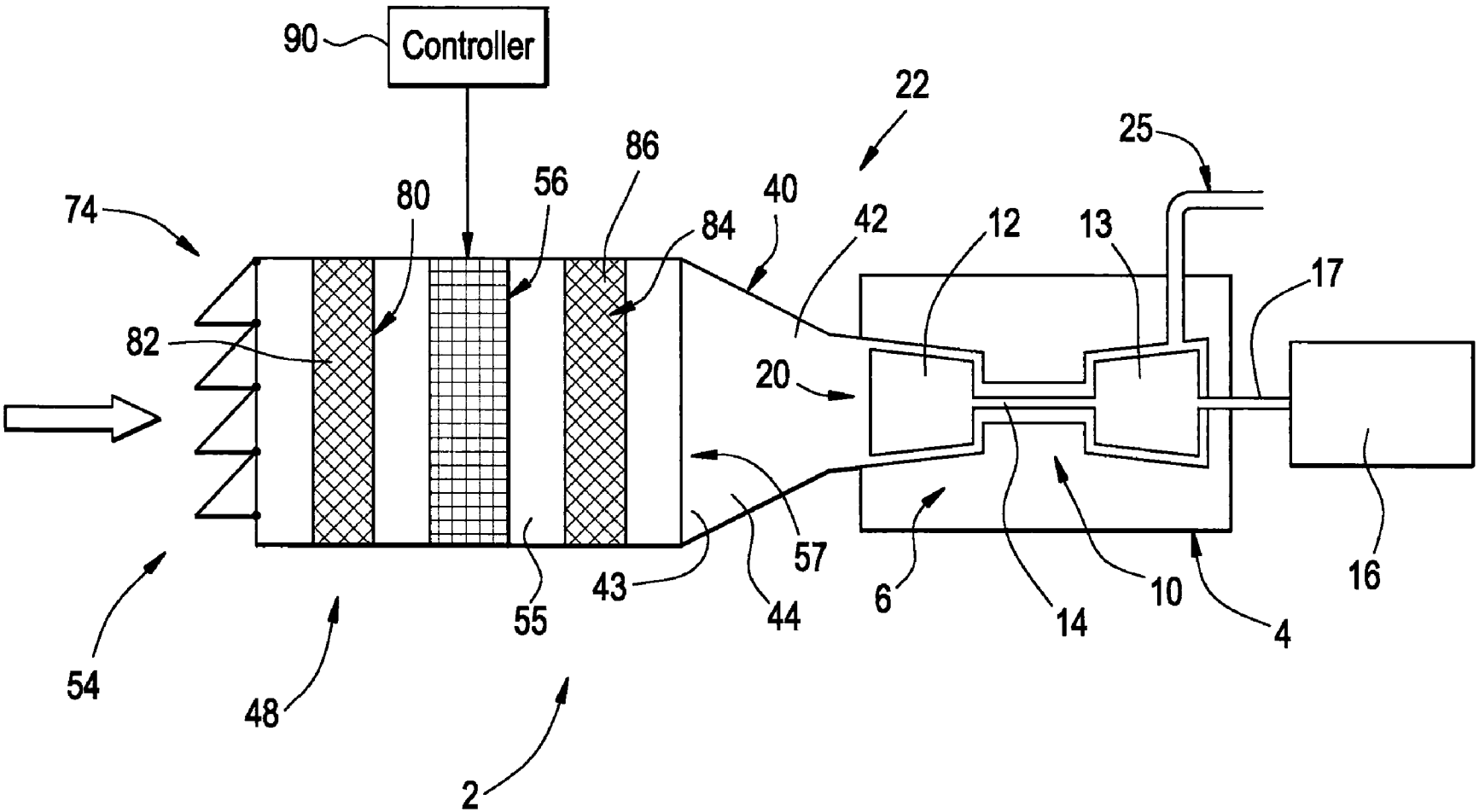
FIG. 2 is a schematic view of the turbomachine system of FIG. 1 illustrating the plurality of selectively movable vanes in a second position.

With reference to FIGS. 1 and 2, a turbomachine system, constructed in accordance with exemplary embodiments of the invention, is indicated generally at 2. Turbomachine system 2 includes a turbomachine housing 4 having an interior portion 6 within which is arranged a turbomachine 10. Turbomachine 10 includes a compressor portion 12 that is operatively connected to a turbine portion 13 via a shaft 14 which, in turn, is connected to an electrical power generator 16 via a shaft 17. Compressor portion 12 includes a compressor intake 20 that receives a flow of air through an intake system 22. That is, air flowing through intake system 22 passes directly to compressor intake 20, while exhaust gases generated by turbomachine 10 pass from turbomachine housing 4 via an exhaust system 25.

In accordance with the exemplary embodiment shown, intake system 22 includes an intake member or duct 40 having a first end portion 42 that extends from turbomachine housing 4 to a second end portion 43 through an intermediate portion 44. Second end portion 43 is fluidly connected to a filter or filtration system 48 positioned upstream of compressor intake 20. Filtration system 48, depending on geographical constraints, removes various substances such as, particulate of various sizes, moisture, salt, and the like from a flow of air passing into intake 20. Towards that end, filtration system 48 includes an intake or inlet region 54 that receives a flow of "unclean" air, a filtration region 55 having a barrier or filtering device 56 for removing foreign objects/debris, and an outlet region 57 that delivers "clean" air to compressor intake 20. In addition, filtration system 48 includes a plurality of louvers 74 arranged at inlet region 54. Louvers 74 block large particles, debris, and the like from entering inlet region 54.

Figure 3:
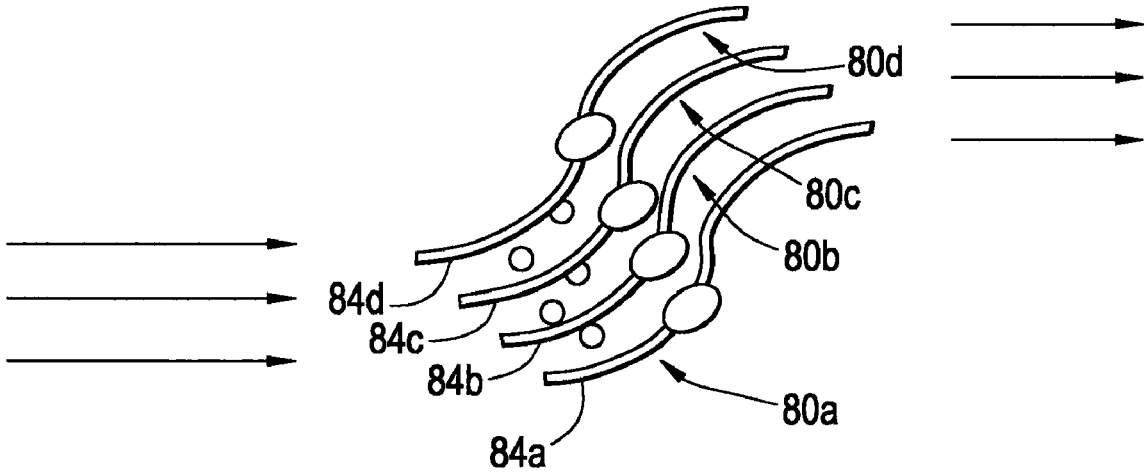
FIG. 3 is a top, schematic view of the plurality of selectively movable vanes in the first position.
Figure 4:
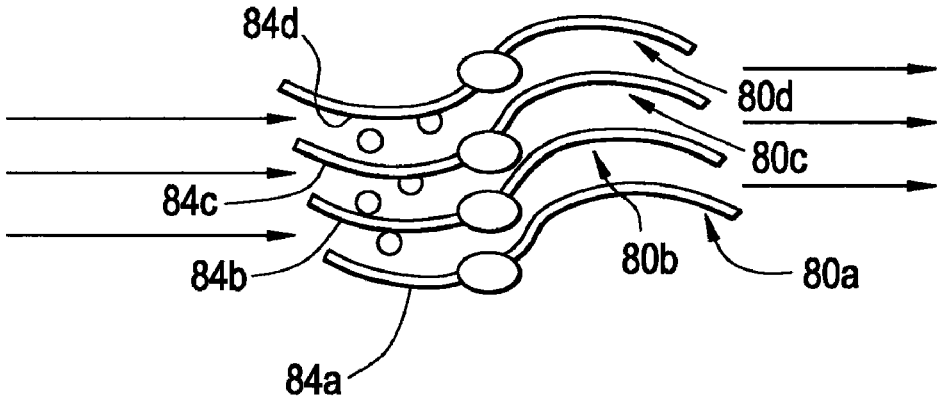
FIG. 4 is a top, schematic view of the plurality of selectively movable vanes in the second position.

In further accordance with the exemplary embodiment of the invention, filtration system 48 includes a first plurality of selectively positional vanes 80*a*-80*d* (FIGS. 3 and 4), arranged up-stream of filtering device 56. Vanes 80*a*-80*d* are movable between a first position, such as shown in FIGS. 1 and 3, to provide a barrier to incoming particles and/or water, and a second position, such as illustrated in FIGS. 2 and 4, establishing an unobstructed flow path for incoming air passing to compressor intake 20. More specifically, when in the first position, vanes 80*a*-80*d* remove a first amount of foreign particles or particulate from the incoming air at a first pressure drop. When in the second position, vanes 80*a*-80*d* remove a second amount of foreign particles or particulate from the incoming air at a second, lower pressure drop. That is, when in the first position, vanes 80*a*-80*d* create a flow restriction that results in a pressure drop of the air flowing through filtration system 48 into compressor intake 20.

In the exemplary embodiment shown, vanes 80*a*-80*d* are movable about a central vertical axis (not separately labeled) between the first and second positions. Each vane 80*a*-80*d* includes a corresponding entrapment or blocking surface 82*a*-82*d* that, when in the first position, is selectively positioned across inlet region 54 at various orientations/angular positions depending upon environmental conditions. In the exemplary embodiment shown, blocking surfaces 82*a*-82*d* are curvilinear in order to maximize contact surface area while still maintaining a narrow profile. In any event, by positioning vanes 80*a*-80*d* across inlet region 54 as shown in FIG. 3, blocking surfaces 82*a*-82*d* present a large contact surface area that is exposed to incoming air so as to trap most, if not all, particles entering intake system 22. However, the large contact surface area creates a correspondingly high pressure drop of air passing into compressor intake 20. Accordingly, vanes 80*a*-80*d* are selectively positionable between the first position and the second position. When in the second position, blocking surfaces 82*a*-82*d* present a smaller contact surface area that is exposed to the incoming airstream such that any pressure drop is minimized.

More specifically, when environmental conditions require extra filtering, such as, but not limited to, during high seas, storms, high particulate days, sandstorms, and the like, vanes 80*a*-80*d* are shifted to the first position such that blocking surfaces 82*a*-82*d* are positioned to block and/or entrap water/dust and/or other particles entering inlet region 54. The particles are carried away from vanes 80*a*-80*d* via ducts (not shown) that lead to a collection area or drain (also not shown). When environmental conditions change, vanes 80*a*-80*d* are shifted to the second position to provide a substantially unobstructed flow path to compressor intake 20. When in the second position, blocking surfaces 82*a*-82*d* are substantially parallel to incoming airflow. Moreover, depending upon environmental conditions, vanes 80*a*-80*d* are shifted to anywhere between the first and second positions to maximize air flow into inlet region 54 while still providing a first level of defense for turbomachine 10.

In accordance with another exemplary embodiment of the invention, filtration system 48 includes a second plurality of selectively movable vanes, one of which is indicated at 84, arranged down-stream of filtering device 56. In a manner similar to that described above, vanes 84 are movable between a first position, such as shown in FIGS. 1 and 3, to present a large contact surface area that is exposed to incoming air and thus provide a barrier to incoming particles and/or water, and a second position, such as illustrated in FIGS. 2 and 4, establishing minimizing exposure of the contact surface to the airflow they presenting an unobstructed flow path for incoming air passing to compressor intake 20. More specifically, in a manner similar to that described above, when in the first position, vanes 84 remove a first amount of foreign particles or particulate from the incoming air at a first pressure drop. When in the second position, vanes 84 remove a second amount of foreign particles or particulate from the incoming air at a second, lower pressure drop. In the exemplary embodiment shown, vanes 84 are movable about a central vertical axis (not separately labeled) between the first and second positions. In any event, each vane 84 includes a corresponding entrapment or blocking surface 86 that, is selectively positioned across outlet region 57 at various orientations/angular positions depending upon environmental conditions.

In a manner also similar to that described above, when environmental conditions require extra filtering, such as, but not limited to, during high seas, storms, high particulate days, sandstorms, and the like, vanes 84 maintained in the first position such that blocking surfaces 86 are positioned to block and/or entrap water/dust and/or other particles entering inlet region 54. The particles are carried away from vanes 80*a*-80*d* via ducts (not shown) that lead to a collection area or drain (also not shown). In this manner, vanes 84 actually serve as an added level of protection for turbomachine 10. However, when environmental conditions change/improve, vanes 84 are shifted to the second position to provide a substantially unobstructed flow path to compressor intake 20.

Vanes 80*a*-80*d* and 84 can be manually shifted, or automatically shifted between the first and second positions, and anywhere in-between. That is, in accordance with one exemplary aspect of the invention, turbomachine system 2 includes a controller 90 operatively coupled to vanes 80*a*-80*d* and 84. In this manner, personnel positioned remote from filtration system 48 can adjust vanes 80*a*-80*d* and 84 as environmental conditions dictate. Moreover, vanes 80*a*-80*d* can be shifted independent of vanes 84 depending on environmental conditions. That is, depending on various environmental factors, vanes 80*a*-80*d* can be placed in the first or blocking position while vanes 84 remain in the second or open position. Once again, it should be understood, that vanes 80*a*-80*d* and 84 can also be selectively positioned anywhere between the first and second positions as conditions dictate.

Controller 90 comprises any appropriate high-powered solid-state switching device. As illustrated, the controller 90 is represented as a computer. However, this is merely exemplary of an appropriate high-powered control, which is within the scope of the invention. For example but not limiting of the invention, controller 90 comprises at least one of a silicon controlled rectifier (SCR), a thyristor, MOS-controlled thyristor (MCT) and an insulated gate bipolar transistor. In the illustrated exemplary embodiment, controller 90 is implemented as a single special purpose integrated circuit, such as ASIC, having a main or central processor section for overall, system-level control, and separate sections dedicated performing various different specific combinations, functions and other processes under control of the central processor section. It will be appreciated by those skilled in the art that controller 90 can also be implemented using a variety of separate dedicated or programmable integrated or other electronic circuits or devices, such as hardwired electronic or logic circuits including discrete element circuits or programmable logic devices, such as PLDs, PALs, PLAs or the like. Controller 90 can also be implemented using a suitably programmed general-purpose computer, such as a microprocessor or microcontrol, or other processor device, such as a CPU or MPU, either alone or in conjunction with one or more peripheral data and signal processing devices. In general, any device or similar devices on which a finite state machine capable of implementing the flow charts, as illustrated in the application can be used as controller 90. As shown a distributed processing architecture is a preferred for maximum data/signal processing capability and speed.

In any event, at this point it should be understood that exemplary embodiments of the invention provide an apparatus for enhancing turbomachine operation. By providing a system that is selectively controlled to prevent foreign particles and liquid/moisture from being ingested by a turbomachine during harsh operating conditions, yet allowing a full flow of intake air during nominal operating conditions without requiring labor intensive filter system modifications, turbomachine efficiency is enhanced. That is, air flow into turbomachine is enhanced across all operating conditions to provide enhanced performance. It should also be understood that the particular positioning of the vanes can vary. That is, the vanes can be mounted at the inlet region, before the filtering device, aft of the filtering device or both before and aft of the filtering device depending upon local conditions/geographical constraints. Moreover the number and geometry (shape) of the vanes can vary in accordance with exemplary embodiments of the invention.

In general, this written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of exemplary embodiments of the present invention if they have structural elements that do not differ from the literal language of the claims, or if they include equivalent structural elements with insubstantial differences from the literal language of the claims.

The invention claimed is:

1. A turbomachine comprising:

a compressor including a compressor intake; and an intake system mounted upstream of the compressor intake, the intake system including a housing and a plurality of selectively positionable vanes arranged within the housing, the plurality of selectively positionable vanes being moveable between a first position to remove a first amount of foreign particles, and a second position to remove a second amount of foreign particles.

2. The turbomachine according to claim 1, wherein the intake system includes an inlet region, the plurality of selectively positionable vanes being arranged at the inlet region.

3. The turbomachine according to claim 1, wherein each of the plurality of selectively positionable vanes includes an entrapment surface, the entrapment surface blocking, at least in part, foreign matter from entering the compressor intake when the plurality of selectively positionable vanes are in the first position.

4. The turbomachine according to claim 3, wherein each entrapment surface is curvilinear.

5. The turbomachine according to claim 1, further comprising: a control operatively connected to the plurality of selectively positionable vanes, the control being adapted to shift the plurality of selectively positionable vanes between the first and second position.

6. The turbomachine according to claim 1, further comprising: a filtering device arranged within the intake system.

7. The turbomachine according to claim 6, wherein the plurality of vanes are arranged up-stream of the filtering device.

8. The turbomachine according to claim 6, wherein the plurality of vanes are arranged down-stream of the filtering device.

9. The turbomachine according to claim 6, wherein the plurality of vanes comprises a first plurality of vanes arranged up-stream of the filtering device and a second plurality of vanes arranged down-stream of the filtering device.

10. The turbomachine according to claim 9, wherein each of the first and second plurality of vanes is separately controllable.

11. A method of controlling airflow through an intake system for a turbomachine, the method comprising:

positioning a plurality of vanes shiftably mounted at the intake system between a first position, and a second position, wherein when in the first position, the plurality of vanes remove a first amount of foreign particles, and wherein when in the second position, the plurality of vanes remove a second amount of foreign particles.

12. The method according to claim 11, wherein, when in the first position, partially blocking an inlet of the intake system with entrapment surfaces provided on each of the plurality of vanes.

13. The method of claim 11, further comprising: automatically shift the plurality of vanes between the first and second positions.

14. The method of claim 11, further comprising: passing an airflow through a filtering device arranged within the intake system.

15. The method of claim 14, wherein when in the first position, the plurality of vanes substantially block foreign particles from entering the turbomachine up-stream of the filtering device.

16. The method of claim 14, wherein when in the first position, the plurality of vanes substantially block foreign particles from entering the turbomachine down-stream of the filtering device.

17. The method of claim 14, wherein when in the first position, the plurality of vanes substantially block foreign particles from entering the turbomachine up-stream and down-stream of the filtering device.

18. The method of claim 17, further comprising: independently controlling a first plurality of vanes arranged up-stream of the filtering device and a second plurality of vanes arranged down-stream of the filtering device.

19. The method of claim 11, wherein positioning the plurality of vanes shiftably mounted at the intake system anywhere between the first position, and the second position comprises rotating the plurality of vanes about a vertical axis.

20. An intake system for a turbomachine comprising:

a housing; and a plurality of selectively positionable vanes arranged within the housing, the plurality of selectively positionable vanes being moveable between a first position to remove a first amount of foreign particles, and a second position to remove a second amount of foreign particles.

* * * * *